United States Patent [19]

Williams et al.

[11] 4,108,115

[45] Aug. 22, 1978

[54] FUEL INJECTION SYSTEMS FOR COMPRESSION IGNITION ENGINES

[75] Inventors: Malcolm Williams, Solihull; Christopher Robin Jones, Alcester, both of England

[73] Assignee: Lucas Electrical Company, Limited, Birmingham, England

[21] Appl. No.: 768,740

[22] Filed: Feb. 15, 1977

Related U.S. Application Data

[63] Continuation of Ser. No. 584,166, Jun. 5, 1975, abandoned.

[30] Foreign Application Priority Data

Jun. 7, 1974 [GB] United Kingdom ..... 25306/74

[51] Int. Cl.[2] ..... F02B 3/00

[52] U.S. Cl. ..... 123/32 EB

[58] Field of Search ..... 123/32 EB, 32 EC, 102, 123/117 R

[56] References Cited

U.S. PATENT DOCUMENTS

| | | | |
|---|---|---|---|
| 3,695,242 | 10/1972 | Tada et al. | 123/102 |
| 3,699,935 | 10/1972 | Adler et al. | 123/102 |
| 3,867,918 | 2/1975 | Williams et al. | 123/32 EA |

FOREIGN PATENT DOCUMENTS

| | | | |
|---|---|---|---|
| 2,303,182 | 7/1974 | Fed. Rep. of Germany | 123/32 EB |

*Primary Examiner*—Ronald B. Cox

*Attorney, Agent, or Firm*—Holman and Stern

[57] ABSTRACT

A fuel injection system for a compression ignition engine includes pulse length control means which determines the instant and duration of opening of a series of injector valves in accordance with the output of a digital memory unit, empirically programmed to match the specific engine. The memory is addressed by two inputs, one derived from an engine speed transducer and the other derived by combining analogue signals from the speed transducer and from a demand transducer. The system operates without any feedback representing the quantity of fuel injected so that no fuel flow transducers are required.

4 Claims, 1 Drawing Figure

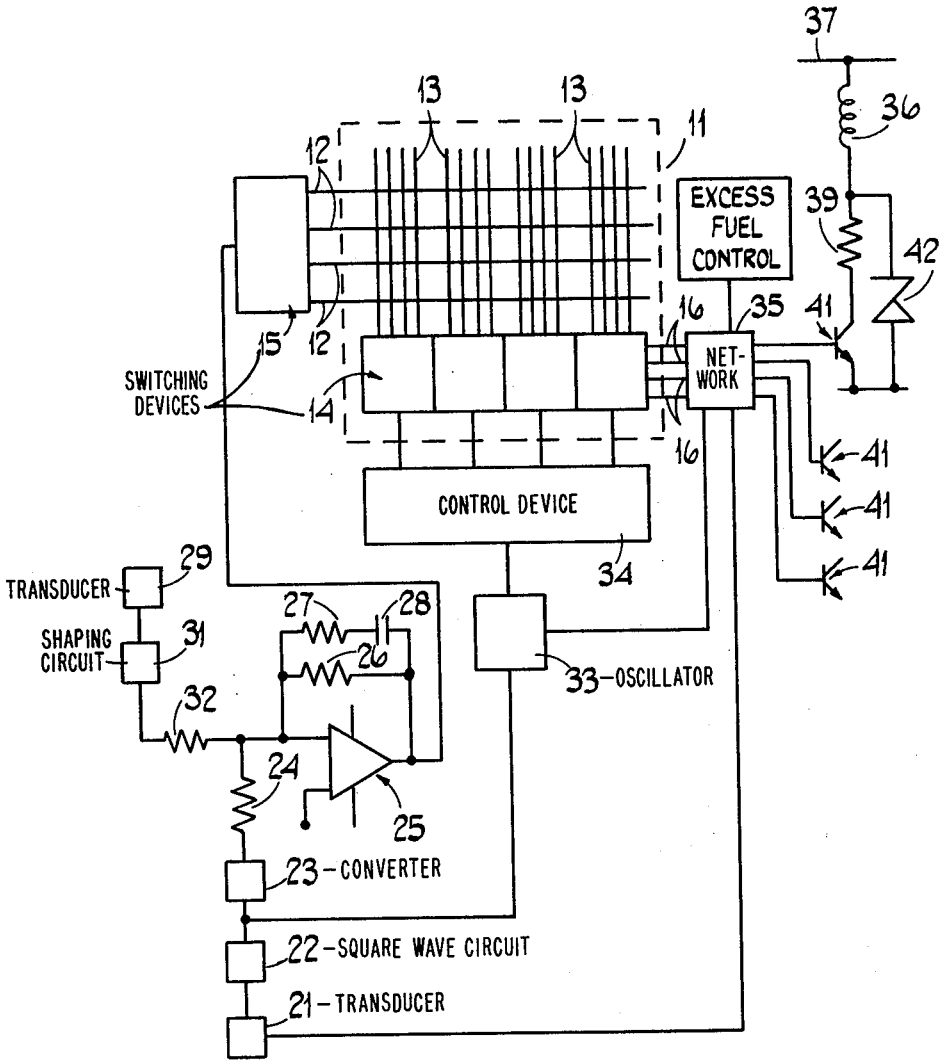
37
36
13
13
11
12
EXCESS FUEL CONTROL
39
42
16
35
41
15
12
NET-WORK
SWITCHING DEVICES
14
16
41
41
41
CONTROL DEVICE
34
TRANSDUCER
29
27
28
SHAPING CIRCUIT
31
26
33-OSCILLATOR
32
24
25
23-CONVERTER
22-SQUARE WAVE CIRCUIT
21-TRANSDUCER

FUEL INJECTION SYSTEMS FOR COMPRESSION IGNITION ENGINES

This is a continuation of application Ser. No. 584,166, filed June 5, 1975, now abandoned.

BACKGROUND OF THE INVENTION

This invention relates to fuel injection systems for compression ignition engines.

SUMMARY OF THE INVENTION

A system according to the invention comprises in combination a first transducer producing an electrical output representing demand, a second transducer producing an electrical output representing engine speed, a memory device having first and second inputs and an output, said device being programmed to produce an output having a magnitude dependent on the magnitude of said inputs, means coupling the second transducer to said first input to represent engine speed, means coupling a combination of the outputs of the first and second transducers to said second input to represent the load on the engine, and control means operable by the output from the memory device for determining the quantity of fuel injected to each cylinder of the engine, the system operating without any feedback representing the quantity of fuel injected.

BRIEF DESCRIPTION OF THE DRAWING

The accompanying drawing is a circuit diagram, partly in block form, illustrating one example of the invention.

DETAILED DESCRIPTION OF A PREFERRED EMBODIMENT

Referring to the drawing, there is provided a memory device 11 of the type known as a read only memory. This device comprises, in the example shown, four input lines 12 and four sets of input lines 13 crossing the lines 12, each set of input lines 13 having four lines. A switching device 14 serves at any given moment to connect one and only one of the sets 13 to four output lines 15, and another switching device 15 serves at any given time to energise one and one only of the lines 12. The lines 12 and 13 are connected in a predetermined manner, so that for a predetermined input to the switching device 15 one of the lines 12 will be energised, and for a predetermined in put to the switching device 14 one of the sets of lines 13 will be coupled to the output lines 16, so that a predetermined signal will appear on the lines 16. This type of device is well known, and it will be appreciated that in a practical application there will be considerably more lines than shown in the drawing.

The arrangement shown is applicable to a compression-ingnition engine driving a road vehicle, and there is provided a transducer 21 producing a alternating output at a frequency dependent on the rotational speed of the engine. This output is fed by way of a square wave circuit 22 to a frequency to voltage converter 23 which produces an output voltage proportional to the rotational speed of the engine. The output from the circuit 23 is fed through a resistor 24 to the inverting input terminal of an operational amplifier 25 the output terminal of which is connected to the switching device 15, which converts the analogue information at its input to digital information at its output. The feedback circuit of the amplifier 25 consists of a resistor 25 having in parallel therewith a resistor 27 and capacitor 28 in series.

The accelerator pedal of the vehicle operates another transducer 29 which produces an output monotonically increasing with depression of the accelerator pedal, that is to say dependent upon demand. This output is fed by way of a shaping circuit 31 and a resistor 32 to the inverting input terminal of the amplifier 25. The amplifier 25 acts as a virtual earth suming amplifier with its gain decreasing with increasing input frequency so as to filter out noise from the two input signals.

The transducers 21 and 29 can have any one of a number of known forms. For example, the transducer 21 can be a simple pulse generator driven by the engine, and the transducer 29 can include a transformer having an a.c. signal applied to its primary winding, the output from the secondary winding being rectified to provide the required signal, and the coupling between the winding being determined by the position of the accelerator pedal.

The output from the amplifier 25 at any given moment will depend upon the demand and the engine speed, and so will be a measure of the load on the engine. This output is fed to the switching device 15, and so the line 12 which is use at any given moment will depend upon the load on the engine. The output from the square wave circuit 22 is fed to a digital control arrangement incorporating an oscillator 33 which produces an output dependent upon engine speed, this output being fed to a control device 34 which in turn operates the switching device 14 to determine which set of lines 13 is connected to the output lines 15. Thus, the memory device 11 receives signals representing engine speed on the one hand, and load on the engine on the other hand, and produces an output dependent on the values of the signals. The device 11 is programmed so that this output represents the quantity of fuel to be injected to a cylinder of the engine.

The lines 16 provide an input to a control network 35 which also receives a timing input from the transducer 21, and a known number of inputs from the oscillator 33, these inputs occurring between pulses from the transducer 21. The network 35 produces one output from each cylinder of the engine at a known cam shaft angle. Thus, associated with one cylinder is a solenoid 36 which when energised opens a valve to supply fuel to the engine at a predetermined pressure. The solenoid 36 has one end connected to a positive supply line 37 and its other end connected to a supply line 38 conveniently at earth potential by way of a resistor 39 and a collector-emitter path of a transistor 41. The junction of the solenoid 36 and the resister 39 is connected through a Zener diode 42 to the line 38, and the base of the transistor 41 is connected to the control network 35. The arrangement is such that at a predetermined instant determined by the output from the transducer 21 and oscillator 33, the transistor 41 is turned on by the control network 35. When the transistor 41 is turned on, the solenoid 36 opens the valve so that fuel is supplied to the appropriate cylinder. The transistor 41 is held on for a predetermined period of time by the control network 35, this predetermined period being determined by the output on the line 16 at that moment in time. The transistors 41 associated with the other cylinders of the engine are indicated in the drawing, and are operated in turn by the control network 35, under the control of signals from the oscillator 33. However, it will be appreciated that the arrangement is not restricted to a fuel system using one solenoid per cylinder.

It will be noted that the entire arrangement operates without the necessity for any feedback signal representing the quantity of fuel being delivered to the engine. Electronic governors for diesel engines have been suggested in which transducers measure demand and engine speed, as in the present example, and also the actual quantity of fuel injected, those transducers then having their outputs combined to determine the quantity of fuel to be injected. Such arrangements involve expensive pumps and transducers for measuring the outputs of the pumps. Using the arrangement shown, in which the memory device 11 in conjunction with the transducers 21 and 29 determines the output without the necessity for a transducer measuring the quantity of fuel injected, far simpler arrangements can be used for actually injecting the fuel, and so in spite of the cost of memory device 11 and its associated arrangements, there is a substantial overall saving in cost.

We claim:

1. A fuel injection system for a compression ignition engine comprising a first transducer producing an electrical output representing demand, a second transducer producing an electrical output representing engine speed, a memory device having first and second inputs and an output, said device being programmed to produce an output having a magnitude dependent on the magnitude of said inputs, means coupling the second transducer to said first input to represent engine speed, means coupling a combination of the output of the output of the first and second transducers to said second input to represent the load on the engine, and control means operable by the output from the memory device for determining the quantity of fuel injected to each cylinder of the engine, the system operating without any feedback representing the quantity of fuel injected wherein said means coupling the outputs of the first and second transducers to the second input includes a virtual earth summing amplifier, the transducers producing outputs increasing monotonically with demand and speed respectively.

2. A system as claimed in claim 1 in which the suming amplifier has a feedback circuit arranged to produce high frequency gain.

3. A fuel injection system according to claim 2 the speed transducer includes a generator which produces an alternating signal of frequency corresponding to engine speed, a pulse-squaring circuit connects to the generator and a frequency-to-voltage converter connected to the pulse-squaring circuit.

4. A system as claimed in claim 3 in which said generator is also connected to the control means to determine the timing of the injection.

* * * * *